US012807282B2

(12) United States Patent
Tian

(10) Patent No.: US 12,807,282 B2
(45) Date of Patent: Nov. 24, 2026

(54) METHOD OF CONVERTING A JET BOARD INTO A PERSONAL WATERCRAFT (PWC) USING GRIPPERS

(71) Applicant: SHANGHAI YUJET, CO. LTD., Kunshan City (CN)

(72) Inventor: Yu Tian, Hong Kong (HK)

(73) Assignee: SHANGHAI YUJET CO., LTD., Jiangsu Province (CN)

( * ) Notice: Subject to any disclaimer, the term of this patent is extended or adjusted under 35 U.S.C. 154(b) by 228 days.

(21) Appl. No.: 18/588,527

(22) Filed: Feb. 27, 2024

(65) Prior Publication Data

US 2024/0190537 A1 Jun. 13, 2024

Related U.S. Application Data

(63) Continuation-in-part of application No. 18/314,058, filed on May 8, 2023, now Pat. No. 11,912,376.

(60) Provisional application No. 63/480,716, filed on Jan. 20, 2023.

(30) Foreign Application Priority Data

| | | |
|---|---|---|
| Oct. 28, 2022 | (CN) | 202211331990.8 |
| Oct. 28, 2022 | (CN) | 202211332030.3 |
| Oct. 28, 2022 | (CN) | 202211332542.X |
| Oct. 28, 2022 | (CN) | 202211332654.5 |
| Oct. 28, 2022 | (CN) | 202211332676.1 |
| Oct. 28, 2022 | (CN) | 202211341386.3 |
| Oct. 28, 2022 | (CN) | 202211341387.8 |
| Oct. 28, 2022 | (CN) | 202211341848.1 |

(51) Int. Cl.

| | |
|---|---|
| ***B63B 32/56*** | (2020.01) |
| ***B63B 32/10*** | (2020.01) |
| ***B63B 34/10*** | (2020.01) |
| ***B63H 21/21*** | (2006.01) |

(52) U.S. Cl.

CPC ..... *B63B 32/56* (2020.02); *B63B 32/10* (2020.02); *B63B 34/10* (2020.02); *B63H 21/213* (2013.01); *B63H 2021/216* (2013.01)

(58) Field of Classification Search

CPC ..... B63B 32/56; B63B 32/10; B63B 34/10; B63H 21/213; B63H 2021/216

See application file for complete search history.

(56) References Cited

U.S. PATENT DOCUMENTS

| | | | | |
|---|---|---|---|---|
| 5,255,625 A * | 10/1993 | Hattori | B63B 35/665 114/55.51 |
| 5,605,110 A * | 2/1997 | Talbot | B63B 35/40 114/77 R |
| 11,912,376 B1 * | 2/2024 | Tian | B63B 32/66 |

FOREIGN PATENT DOCUMENTS

| | | | | |
|---|---|---|---|---|
| CN | 206494089 U * | 9/2017 | B63B 32/10 |

* cited by examiner

*Primary Examiner* — Stephen P Avila
(74) *Attorney, Agent, or Firm* — WPAT LAW, P.C.; Anthony King

(57) ABSTRACT

A method to convert a jet board, which may include an electric surfboard, an electric standup paddle board, an electric hydrofoil board, into a personal watercraft (PWC). The method includes attaching an add-on module onto the jet board using grippers. The add-on module provides handles and a seat but does not provide a source of propulsion. The resulting personal watercraft is, instead. driven by the propulsion system of the jet board.

17 Claims, 19 Drawing Sheets

METHOD OF CONVERTING A JET BOARD INTO A PERSONAL WATERCRAFT (PWC) USING GRIPPERS

CROSS-REFERENCES

This application is a continuation-in-part application of U.S. utility patent application Ser. No. 18/314,058, filed May 8, 2023, now allowed, which claims priority to, and is a non-provisional patent application of, U.S. provisional patent application No. 63/480,716, filed on Jan. 20, 2023, all of which are hereby incorporated by reference in their entireties.

Prior-filed filed application Ser. No. 18/314,058 also claims priority to China Invention Patent Application number 202211332654.5, filed on Oct. 28, 2022, which is hereby expressly incorporated by reference as part of the present disclosure.

Prior-filed filed application Ser. No. 18/314,058 also claims priority to China Invention Patent Application number 202211332676.1, filed on Oct. 28, 2022, which is hereby expressly incorporated by reference as part of the present disclosure.

Prior-filed filed application Ser. No. 18/314,058 also claims priority to China Invention Patent Application number 202211341386.3, filed on Oct. 28, 2022, which is hereby expressly incorporated by reference as part of the present disclosure.

Prior-filed filed application Ser. No. 18/314,058 also claims priority to China Invention Patent Application number 202211341387.8, filed on Oct. 28, 2022, which is hereby expressly incorporated by reference as part of the present disclosure.

Prior-filed filed application Ser. No. 18/314,058 also claims priority to China Invention Patent Application number 202211341848.1, filed on Oct. 28, 2022, which is hereby expressly incorporated by reference as part of the present disclosure.

Prior-filed filed application Ser. No. 18/314,058 also claims priority to China Invention Patent Application number 202211332030.3, filed on Oct. 28, 2022, which is hereby expressly incorporated by reference as part of the present disclosure.

Prior-filed filed application Ser. No. 18/314,058 also claims priority to China Invention Patent Application number 202211332542.X, filed on Oct. 28, 2022, which is hereby expressly incorporated by reference as part of the present disclosure.

Prior-filed filed application Ser. No. 18/314,058 also claims priority to China Invention Patent Application number 202211331990.8, filed on Oct. 28, 2022, which is hereby expressly incorporated by reference as part of the present disclosure.

FIELD OF THE DISCLOSURE

The present disclosure relates to a watercraft, more particularly, a recreational personal watercraft.

BACKGROUND OF THE INVENTION

Generally, a personal watercraft (PWC) is a small recreational watercraft that is designed to be ridden like a motorcycle or scooter on water. It is typically powered by a jet propulsion system that uses a powerful water pump to shoot a high-pressure jet of water out of the back of the watercraft, propelling it forward. A personal watercraft is popular for use in a variety of water-based activities such as water sports, recreational riding, and racing. They are commonly used in lakes, rivers, and coastal areas around the world.

Owning a personal watercraft (PWC) can be a fun and exciting way to enjoy the water, but the cost of buying, maintaining, and transporting one can be challenging for many. PWCs require regular maintenance and upkeep to keep them in good working condition. This can be time-consuming and expensive, and may include tasks such as winterization, engine maintenance, and hull cleaning. PWCs can also have a negative impact on the environment as they can contribute to water pollution through oil and fuel leaks. Further, PWCs are typically stored on trailers when not in use, which can be bulky and difficult to store. They also require a vehicle with a hitch and sufficient towing capacity to transport them to and from the water.

There is a need for ways to enjoy owning and maintaining a PWC that is less costly to buy, to maintain, and to store.

There is a need for ways to enjoy using a PWC where transporting it is easier than transporting personal watercraft currently available in the market.

There is a need for ways to enjoy a PWC with less negative impact on the environment.

SUMMARY OF THE INVENTION

The current disclosure provides a method of converting a jet board into a personal watercraft (PWC). The method includes first providing an add-on module that is capable of being detachably attached to the jet board.

In one aspect combinable with the general implementation, the add-on module itself is not motorized and it does not have a way to propel itself in water.

In another aspect combinable with the general implementation, the detachably attaching step includes placing the add-on module over a front end or at least a front half of the jet board.

In another aspect combinable with the general implementation, the detachably attaching step includes sliding the add-on module over a front end or at least a front half of the jet board.

In another aspect combinable with the general implementation, the detachably attaching step includes inserting a front end or at least a front half of the jet board into a corresponding structure underneath the add-on module.

In another aspect combinable with the general implementation, the method includes providing at least one handle coupled to the hull of the add-on module so a rider in a riding position may hold on to the add-on module by holding the handle.

In another aspect combinable with the general implementation, providing a coupler to the add-on module, and using the coupler to secure the jet board to the add-on module.

In another aspect combinable with the general implementation, the coupler can be a tether, a strap, a line, a rope, an elastic band.

In another aspect combinable with the general implementation, the method includes providing a hook or a catcher at a distal end of the coupler.

In another aspect combinable with the general implementation, the method can include attaching the hook or the catcher to a corresponding protrusion (e.g., a handle) found at rear portion of the jet board in order to keep the jet board from detaching from the add-on module. This attachment can bias the jet board towards the add-on module.

In another aspect combinable with the general implementation, the coupler can be a movable clamping ram, or grippers, and wherein the detachably attaching and securing step can include using the clamping ram to abut the jet board against a portion of the add-on module to keep it from detaching from the add-on module.

In another aspect combinable with the general implementation, the method may include using a tool to adjust the movable clamping ram, or grippers.

In another aspect combinable with the general implementation, the clamping ram/grippers may apply direct pressure to the lateral sides of the jet board.

In another aspect combinable with the general implementation, the clamping ram/grippers may apply direct pressure to the underside of the jet board to press the jet board against the bottom of the add-on module.

In still another aspect combinable with the general implementation, the securing step can include wrapping a strap over the underside of the jet board and tying the jet board to the underside of the add-on module in order to keep it from detaching from the add-on module.

In another aspect combinable with the general implementation, the securing step can include securing the coupler over the rear end of the jet board to keep it from detaching from the add-on module.

In another aspect combinable with the general implementation, the coupler can include a fastener, such as a screw, a toggle latch, a cam lock, or any other suitable hardware so a user may fasten the fastener to a corresponding part of the jet board to keep it from detaching from the add-on module.

In another aspect combinable with the general implementation, further providing a receiving channel as part of the hull, either under the hull or within the hull, such that a user may fit a portion of the jet board snugly between at least two inner walls of the receiving channel.

In another aspect combinable with the general implementation, the receiving channel can have a shape that corresponds with an outer contour of at least a front end of the jet board.

In another aspect combinable with the general implementation, the receiving channel can be disposed on an underside of the hull so that the jet board can slidingly receive therein and the bottom side of the front end of the jet board is still visible and not covered by the add-on module.

In another aspect combinable with the general implementation, the receiving channel can be disposed in an interior of the hull of the add-on module to slidably receive the jet board therein.

In another aspect combinable with the general implementation, the add-on module is detachably attached to the jet board by inserting at least the front end of the jet board into an opening disposed at the rear end of the add-on module.

In another aspect combinable with the general implementation, the add-on module is detachably attached only to the front end of the jet board.

In another aspect combinable with the general implementation, the add-on module is detachably attached only to the front end and to two rear side handles of the jet board.

In another aspect combinable with the general implementation, the add-on module does not have a source of propulsion and the PWC is driven forward by the electric propulsion system of the jet board.

In another aspect combinable with the general implementation, when the jet board has a handheld controller (whether it is remotely controlled or via an attached wire) that allows a user of the jet board to control an output of its electric propulsion system, the method can further include attaching the handheld controller of the jet board to the handle of the add-on module, thereby allowing a user to adjust the output of the PWC while holding on to the handle of the add-on module.

In another aspect combinable with the general implementation, providing a seat to the add-on module thereby allowing a user to sit on the resulting PWC. Also, providing the seat to be pivotably attached to the hull so that the user may gain access to the battery of the jet board when the jet board is secured to the add-on module.

In another aspect combinable with the general implementation, the add-on module has no electrically-powered parts.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF DRAWINGS

It should be noted that the drawing figures may be in simplified form and might not be to precise scale. In reference to the disclosure herein, for purposes of convenience and clarity only, directional terms such as top, bottom, left, right, up, down, over, above, below, beneath, rear, front, distal, and proximal are used with respect to the accompanying drawings. Such directional terms should not be construed to limit the scope of the embodiment in any manner.

Figure 1:
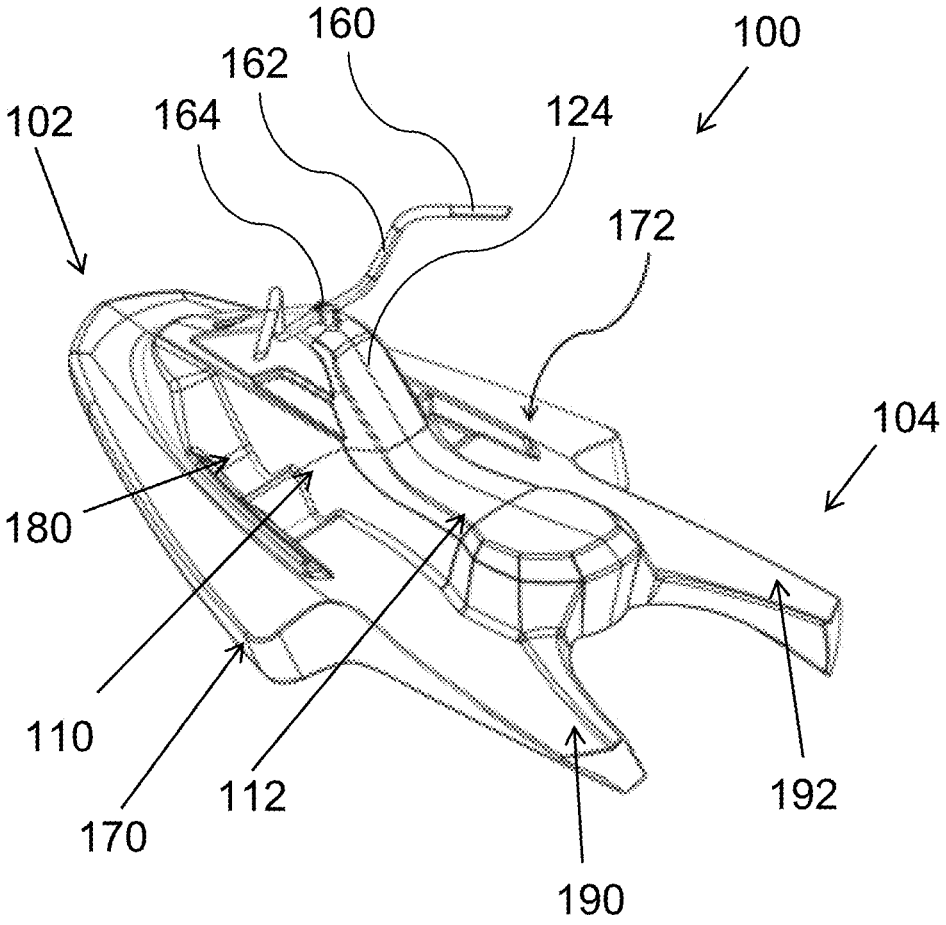
FIG. 1 is a perspective view of one embodiment of an add-on module according to an aspect of the disclosure.

The following call-out list of elements in the drawing can be a useful guide when referencing the elements of the drawing figures:

100 Add-on Module
102 Bow
104 Stern
110 Hull
112 Seat
120 Protruding Part
121 Slit Opening
122 Connecting Protrusion
123 First Hole
124 Console
130 Docking Area
135 Bottom of the Docking Area
140 Groove
150 Gripper
151 Grip Part
152 Base Part
153 Second Hole
154 Securing Pin
160 Hand Grip
162 Handlebar
164 Stem
170 Port Side Wing
172 Starboard Side Wing
180 Footwell
190 Left Transom Extension
192 Right Transom Extension
200 Jet Board
210 Handle
212 Battery Access Cover
221 Hydrofoil Board
222 Surfboard
223 Standup Paddle (SUP) Board
224 Line of Arrow
225 Boogie Board
240 Handheld Controller
300 Coupler
311 Fastener
312 Elastic Band
312' Elastic Band
313 Hook
313' Catcher
320' Button
800 Personal Watercraft (PWC)
3110 Hole

DETAILED DESCRIPTION

The different aspects of the various embodiments can now be better understood by turning to the following detailed description of the embodiments, which are presented as illustrated examples of the embodiments as defined in the claims. It is expressly understood that the embodiments as defined by the claims may be broader than the illustrated embodiments described below.

As used herein, the term "personal watercraft" or "PWC" refers to a type of recreational watercraft that is designed for one to three people to ride on. It is commonly known by brand names such as Jet Ski™, WaveRunner™, and Sea-Doo™. It is typically ridden like a scooter if a seat is offered. It may also be without a seat and the rider would ride it standing up.

Figure 16:
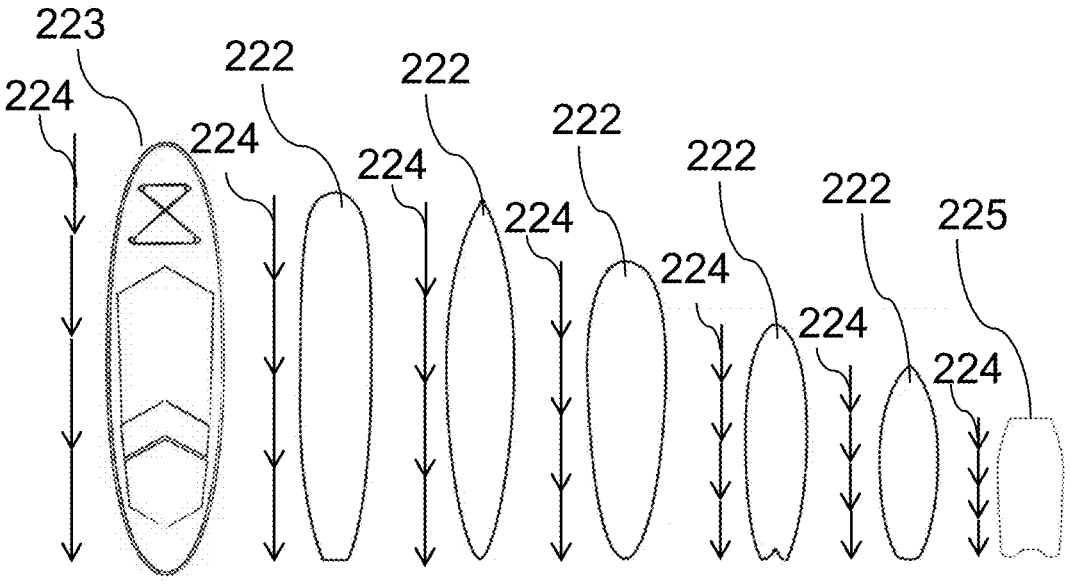
FIG. 16 represents the contemplated percentage coverages the various sizes of add-on module over various sizes of jet boards.

As used herein, the term "jet board" refers to a jet-powered board or electric board both of which can be in the form of a surfboard (see 222 of FIG. 16 illustrating surfboards of various sizes), a standup paddle board (see 223 of FIG. 16), an electric boogie board (see 225 of FIG. 16), and a hydrofoil board (see 221 of FIG. 17) which generally has a board size and shape similar to the a boogie board (225). A jet board is a watercraft that allows the rider to surf on the water without the need for waves. It is typically powered by one or two electric motors or a jet engine, which propels the board forward through the water. If the board has a hydrofoil, it is sometimes called an e-foil.

The inventors have discovered a quick and easy way to convert a jet board into a personal watercraft (PWC).

FIG. 1 generally depicts the basic structure of an add-on module 100 in accordance with the disclosure.

The add-on module 100 can have a relatively light overall weight, with relatively simple construction. It can have a hull 110, a bow 102, a stern 104, a left transom extension 190, a right transom extension 192, a handle grip 160, a handlebar 162, and a stem 164.

The contemplated hull 110 can be made of suitable materials to withstand the stresses of traveling over the water, including waves, wind, and impacts from floating debris. It can be a material that is able to withstand exposure to moisture, sun, and other elements without deteriorating or corroding over time. The contemplated material can include lightweight material which can improve the PWC's speed and efficiency. This material is contemplated to have a stiffness to help the hull to maintain its shape and resist deformation while underway. Such materials include natural and synthetic polymers, various metals and metal alloys, naturally occurring materials, textile fibers, and all reasonable combinations thereof.

In some embodiments, the contemplated hull 110 can be made of plastic by injection molding, but the disclosure is not limited thereto. In some embodiments, the contemplated hull 110 can be made of high-density foam, but the disclosure is not limited thereto. In some embodiments, the contemplated hull 110 can be made of wood, but the disclosure is not limited thereto. Other contemplated material may include steel, aluminum, fiber-reinforced plastic (FRP), and polyethylene, but the disclosure is not limited thereto.

The bow 102 can resemble the bow of a typical PWC by having the appropriate curvature consideration that can affect performance and safety. The shape of the bow can affect how easily the PWC can turn and change direction. A more curved bow can allow for sharper turns, while a flatter bow may be more difficult to maneuver.

Another key factor for an appropriate curvature consideration is to improve handling in waves. A PWC with a more curved bow can help to absorb and deflect waves, reducing the impact felt by the rider. This can improve the ride quality and reduce the risk of injury or discomfort.

Above the hull 110 there can be a pair of handlebars 162. The pair of handlebars 162 are joined together towards the console 124 by a stem 164. The console 124 may contain instruments to display mechanical or digital gauges or provide information or entertainment. In some embodiments, this console 124 does not have any instruments and gauges and can simply be a hollow structure where the stem 164 is attached.

Stem 164 can or cannot be rotatable relative to the console 124. In one embodiment, a rider may turn the handlebar left and right, and such turning can be made possible by having rotatable stem 164 that is rotatably fixed to the console 124.

In another embodiment, the rider may not turn the handlebar left and right. The stem 164 can be fixedly attached to the console 124 and not rotatable relatively to the console 124. In this embodiment, the rider hangs on to the handlebar 162 to help keep himself or herself stabilized.

At the terminal ends of the handlebars 162 there can be hand grips 160.

During riding over water, the hull 110 has a width such that the waterline is expected to reach both the bottom of the port side wing 170 and the bottom of the starboard side wing 172 as will be discussed in more detail in FIG. 5.

In some embodiments, the contemplated add-on module 110 can have a seat 112 behind the console 124. In other embodiments, no seat is provided, and a rider may stand behind the console 134, holding the handlebars 162. In such embodiments, the handlebars 162 would be higher thereby making it easier for a standing rider to hang on to.

There can be a footwell 180 on the port side and a footwell on the starboard side of the add-on module, allowing the rider to rest his or her feet. The footwell 180 is contemplated to simply be a receiving structure of no mechanical moving parts.

In most embodiments, the add-on module 110 has no electric-driven moving parts, but the disclosure is not limited thereto. In other embodiments, the add-on module does not have any fuel-power or electric-powered propulsion system, but the disclosure is not limited thereto.

Contemplated add-on module 100 can have a left transom extension 190 and a right transom extension 192 at the stern 162 of the add-on module 100. These transom extensions 190, 192 can make added surface contacts with the top side of a jet board (as shown in FIGS. 5, 6, 7, 9) for stabilization. In most embodiments, the bottom sides of these transom extensions 190, 192 make no contact with the water and they are not part of the hull 110.

In one embodiment, the hull 110, the port side wing 170, the starboard side wing 172, the console 124, the left transom extension 190, the right transom extension, can all be a single integral piece manufactured by injection molding. For example, it can be a hollow plastic housing having all these parts.

In another embodiment, the entire add-on module 100 shown in FIG. 1, except the stem 164, the handlebar 162, and the hand grips 160, can be manufactured by injection molding, and it contains no more than two pieces of moving parts assembled together.

In still yet another embodiment, the entire add-on module 100 shown in FIG. 1, except the stem 164, the handlebar 162, and the hand grips 160, can be manufactured by injection molding, and it contains no more than three pieces of moving parts assembled together.

Figure 2:
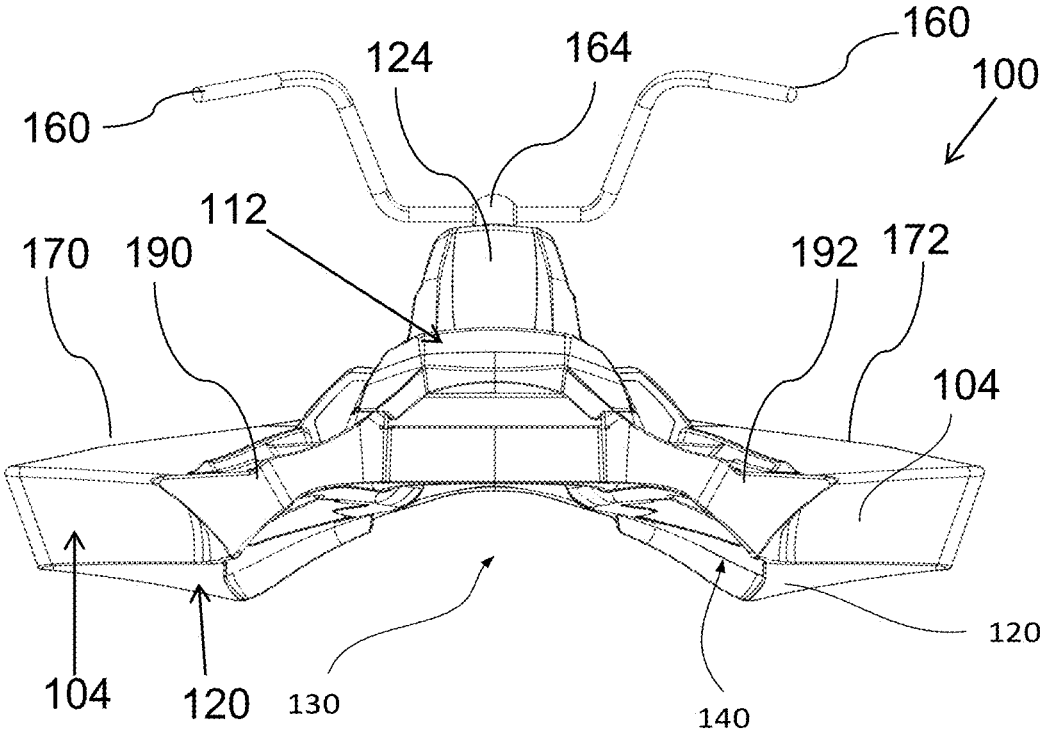
FIG. 2 is a rear view of the add-on module of FIG. 1.

Referring now to FIG. 2 which shows a rear view of the add-on module 100. Here in the rear view the port side wing 170 and the starboard side wing 172 are each shown to have a protruding part 120 disposed at the bottom of the port side wing 170 and the starboard side wing 172. In most embodiments, the protruding parts 120 form part of the bottom of the hull 110.

On both the portside and the starboard side, both protruding part 120 come sloping down toward the center longitudinal line of the add-on module 100 and abruptly ends such that the two protruding parts 120 do not meet in the mid-center line of the add-on module 100. The protruding part 120 abruptly ends and sharply cuts back upwards thereby forming a groove 140. The groove 140 can come in various shapes. In one embodiment, the shape of the groove 140 corresponds closely with the size and model of the jet board the add-on module 100 is designed to fit over.

In between the groove 140 on the port side and the groove 140 on the starboard side there is an empty space generally under the seat 112 of the add-on module 100. This empty space is a docking area 130 where a jet board 200 can be inserted into and docked.

In one embodiment, the grooves 140 alone are sufficient to capture the jet board 200 can keep it from falling off from the add-on module 100. That is, when a jet board 200 is docked into the docking area 130, the grooves 140 can keep the front end of the jet board 200 from any vertical movement. Any such vertical movement is undesired because during operation, an impact from a wave can easily dislodge the jet board 200 form the add-on module unless there is some means to restrict such relative vertical movement between the jet board 200 and the add-on module 100.

In some embodiments, there can be additional securing means on the add-on module 100 to make engaging contacts with the jet board to secure the jet board 200 in place. There additional securing means can include, but not limited to, a clamp (not shown), a toggle latch (not shown), a screw (not shown), a strap (not shown), a line (not shown).

In FIG. 2, the docking area 130 has an open bottom. In other words, the bottom of the docking area is exposed to open water. In other embodiments such as the one shown in FIG. 3, there can be a bottom 135 to the docketing area 130. The bottom 135 effectively creates a pocket to receive a jet board 100 therein. The bottom 135 can prevent the jet board 200 from any vertical movement and therefore more securely keeps the jet board 200 in place.

In other embodiments where there is a bottom 135 to the docking area 130, there may not necessarily need any grooves 140 because the bottom 135 itself can sufficiently capture the jet board 200 in place. This embodiment would effectively allow many shapes and sizes of jet board 200 to be inserted and received within the docking area 130.

Figure 3:
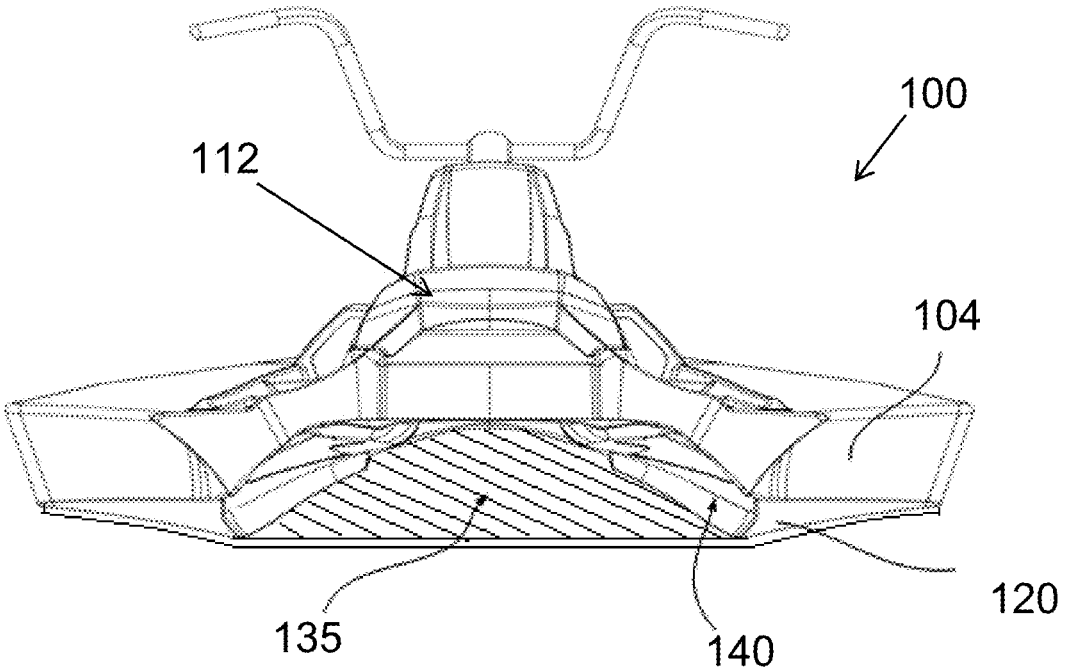
FIG. 3 is a rear view of another embodiment of the add-on module.

Although the bottom 135 of the docking area 130 shown in FIG. 3 is flat, the bottom can simply be part of the bottom of the hull 110 that curves down towards a center longitudinal line and forms a center spine similar to the bottom of the hull in a typical PWC.

As discussed above, the grooves 140 essentially forms a receiving channel that is either part of the hull 100 structure, or the receiving channel and be a separate structure coupled to the hull 100. Either way, the rider would fit a portion of the jet board 200 snugly between at least two inner walls (e.g., the grooves 140) of the receiving channel.

To convert a jet board 200 into a personal watercraft (PWC), a rider would place the add-on module 100 over the front end of the jet board 200. This method step corresponds with the embodiment of add-on module 100 shown in FIG. 2. After the add-on module 100 is generally placed over the front end of the jet board 200, the rider would then slide the front end of the jet board 200 into place by making sure an engaging contact is made between the sides of the jet board and the grooves 140.

Alternatively for the embodiment in FIG. 3, a rider would insert the front end of the jet board 200 into an opening at the rear end of the add-on module 100 so that at least a front end of the jet board 200 is enveloped within the docketing area 130. This structure resembles a pocket. In this way, a portion of the jet board 200 is sandwiched between the bottom 135 of the docking area 130 and the seat 112.

At this point, a front end of the jet board 200 is in engaging contact with the add-on module 100. In some embodiments, this engaging contact is limited to merely a top side of the jet board 200 contacting the add-on module 100 (not shown). In other embodiments, this engaging contact further includes the lateral sides of the jet board 200 (i.e., embodiment of FIG. 2). In still yet other embodiments, this engaging contact further includes the bottom side of the front of the jet board 200 (not shown).

Figure 5:
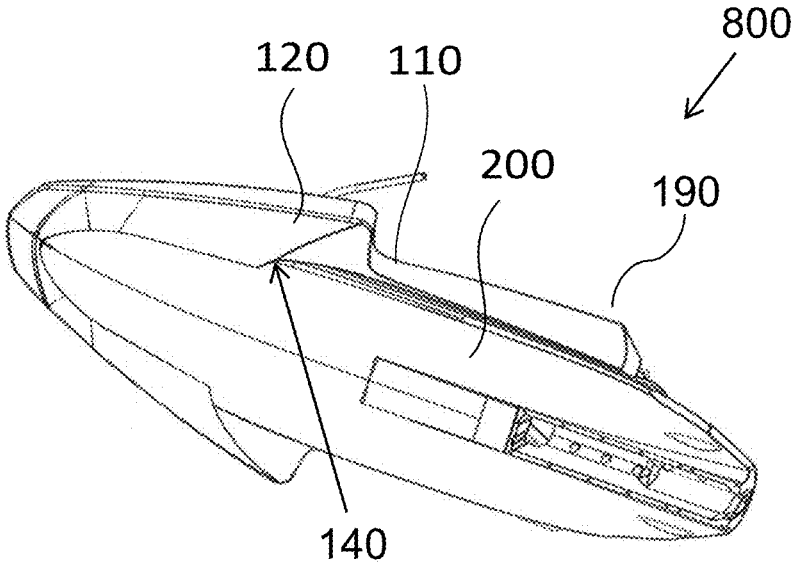
FIG. 5 is a bottom perspective view of the contemplated add-on module with a prior art jet board inserted.
Figure 6:
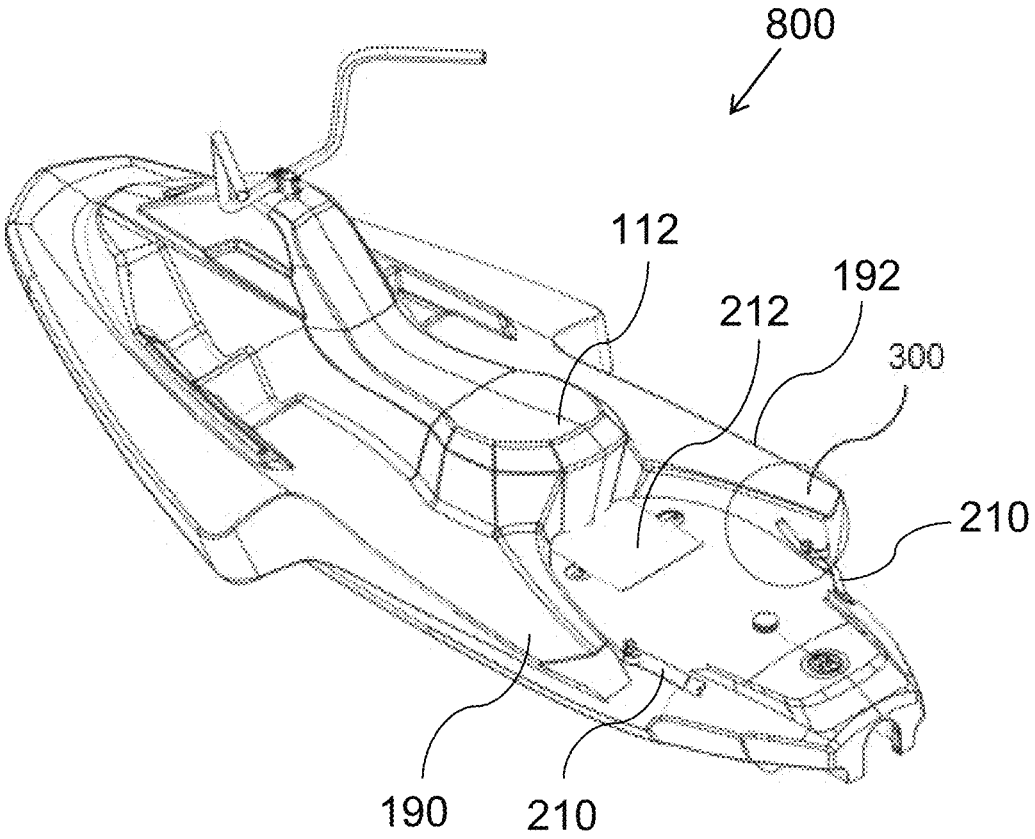
FIG. 6 is a perspective view of a personal watercraft resulting from the combination of the contemplated add-on module and a prior art jet board.
Figure 7:
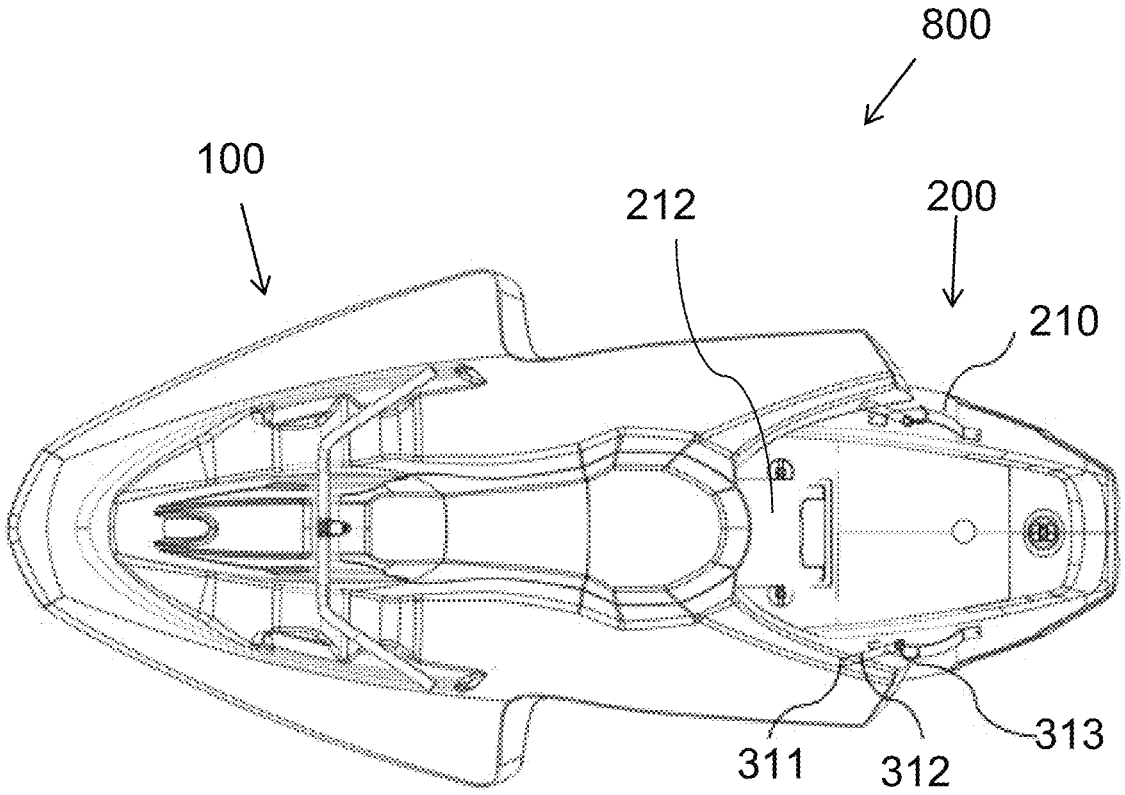
FIG. 7 is a top view of the personal watercraft of FIG. 6.

FIGS. 5, 6, and 7 illustrate the add-on module 100 partially enveloping the front end of the jet board 200.

In FIG. 6, the battery access cover 212 of the jet board 200 appears to be just a little more than halfway covered over by the tail end of the add-on module 100. This is to say that, looking from top down and looking at the center longitudinal line of the jet board 200, this particular jet board 200 in FIG. 6 is about 50 to 60% covered by the add-on module. Notice this percentage coverage does not take into consideration how far back the add-on module's two transom extensions 190, 192 reach back beyond the tail end of the seat 112. Referring now to FIG. 16, various jet boards and their sizes and lengths relative to each other are shown. The lines of arrows 224 next to each jet board are a representation of contemplated coverages of the add-on module over the jet board. As illustrated in the first top arrow, in some embodiments, the contemplated add-on module 100 has a tail end length that covers over at least the first 25% of the top side of the jet board. As illustrated in the first two top arrows, in some embodiments, the contemplated add-on module 100 has a tail end length that covers over at least the first 50% of the top side of the jet board. As illustrated in the first three top arrows, in some embodiments, the contemplated add-on module 100 has a tail end length that covers over at least the first 75% of the top side of the jet board. As illustrated by all four arrows in a line, in some embodiments, the contemplated add-on module 100 has a tail end length that covers over the entire 100% of the top side of the jet board. A larger coverage may need a longer add-on module 100, which may be a two- or three-passenger model having a longer seat bench.

Figure 17:
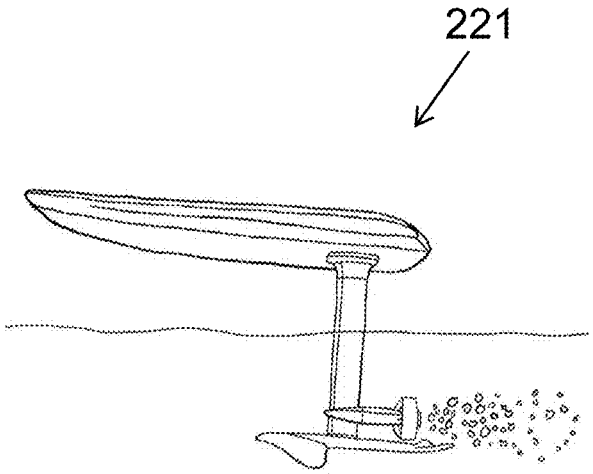
Fig. 17 Prior Art
FIG. 17 is a side view of a prior art hydrofoil board.
Figure 18:
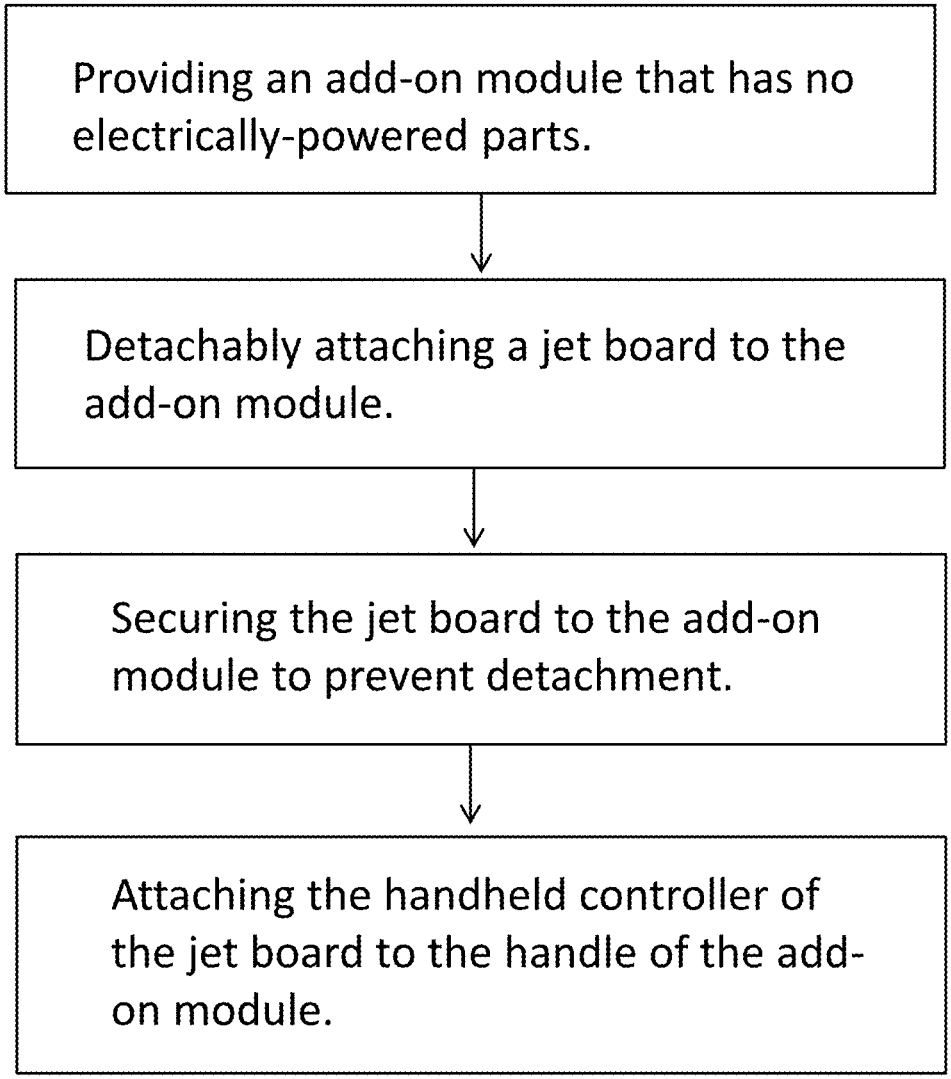
FIG. 18 illustrates one embodiment of method steps to convert a prior art jet board into a personal watercraft.

It should be noted that when the contemplated jet board 100 is a hydrofoil board 221 similar to that shown in FIG. 17, the resulting PWC is not expected to levitate above water as a hydrofoil board 221 typically would. The propulsion system of hydrofoil board 221, however, is still expected to provide sufficient propulsion to the resulting PWC.

Figure 4:
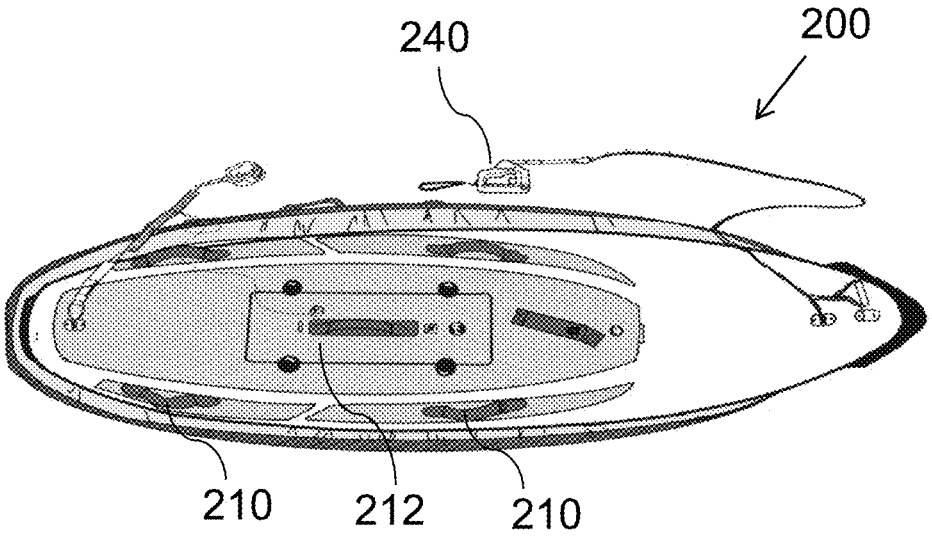
Fig. 4 Prior Art
FIG. 4 is a top view of a prior art jet board.

FIG. 4 shows a prior art jet board 200 having handles 210 that came preinstalled by its manufacturer. This same jet boar 200 is shown in FIGS. 6 and 7.

FIG. 5 shows the bottom view of the embodiments of FIG. 2 where the jet board 200 has its front end slidingly engaged with the grooves 140 and the bottom of the front end of the jet board 200 is exposed during operation. In this view, the electronic propulsion system that came with a typical jet board 200 is shown.

Next, the rider would additionally secure the jet board 200 to the add-on module 100 using a coupler 300. An exemplary coupler 300 is shown in FIGS. 6, 7. Here, a coupler 300 can be a tether such as an elastic band 312 with one end fixed to the hull 110 of the add-on module 100 using a fastener 311, and its other end can have a hook 313. This elastic band 312 can be permanently fixed to the hull 110 by the fastener 311. Alternatively, this elastic band 312 can be detachably attached to the hull 110 by fastener 311. The rider would manually stretch the elastic band 312 and pull the hook 313 towards the handle 210 of the jet board 200. In FIG. 7, the elastic band 312 is stretched and the hook 313 is connected to the handle 210 thereby applying a pulling action to pull the jet board 200 towards the add-on module 100 thereby forming a PWC 800.

Figure 10:
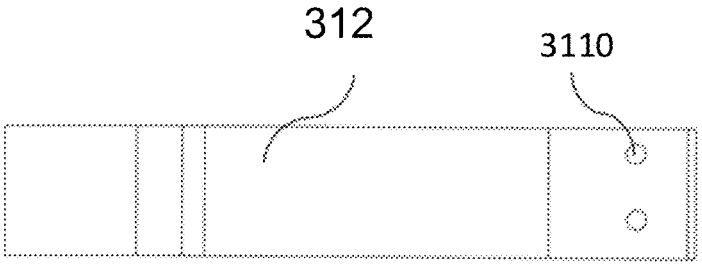
FIG. 10 is a top view of an elastic strap according to one aspect of the disclosure.
Figure 11:
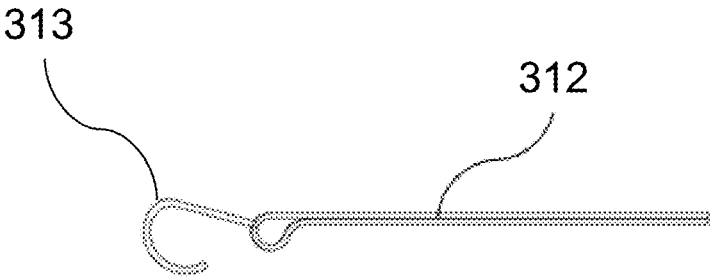
FIG. 11 is a side view of an elastic strap and a hook according to one aspect of the disclosure.

FIGS. 10 and 11 provide a close-up view of an exemplary elastic band 312 and hook 313 combination. In FIG. 10, elastic band 312 can have holes 3110 for receiving fasteners 311. Fasteners 311 drives through the holes 3110 to secure the elastic band 312 to the transom extensions 190, 192.

It is contemplated that some jet boards 200 may not have a set of handles 210 that came pre-installed by the manufacturer. One of ordinary skill in the art would see the possibility of installing after-market handles onto such jet boards 200 so that the hook 313 of the add-on module 100 can attach to it.

Figure 8:
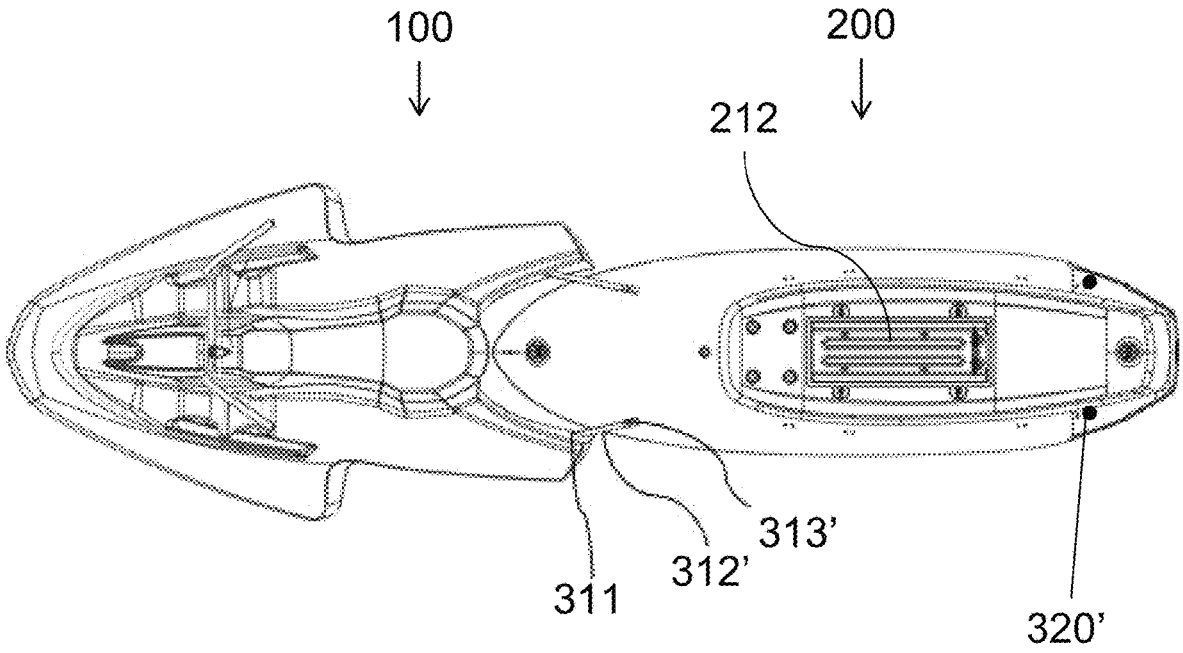
FIG. 8 is a top view of another embodiment of the add-on module ready to engage with a prior art jet board.
Figure 12:
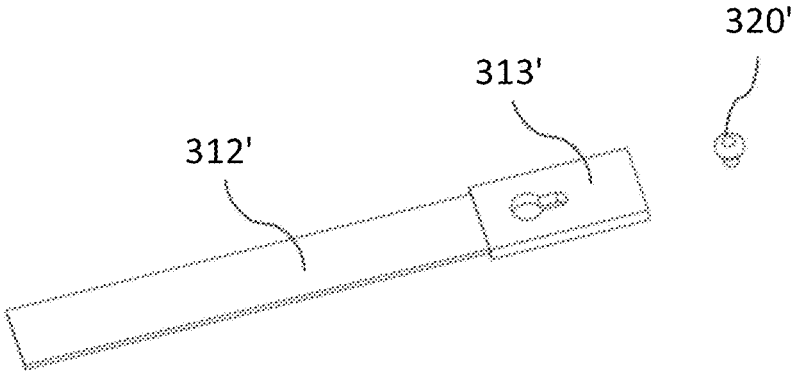
FIG. 12 is a perspective view of an elastic strap and a button according to another aspect of the disclosure.

Instead of handles, there can be other types of hardware or structure on the jet board 200 so that a hook 313 or similar hardware of the add-on module 100 can attach to it. For example, in the embodiment shown in FIGS. 8, 9, and 12, an elastic band 312' can be fastened to the hull 110 of the add-on module 100 on one end by fastener 311, and its other end can have a catcher 313' having a keyhole shaped opening. The keyhole opening can fit over a button 320' that can generally have a mushroom head shape. This button 320's can be installed on the top side of the jet board 200, wherever appropriate so that the elastic band 312' can stretch sufficiently for the catcher 313' to couple onto the button 320'. In FIG. 8, the jet board 200 is ready to be inserted into the rear end of the add-on module 100. At this point the elastic band 312' is not stretched and the catcher 313' is not attached to any part of the jet board 200. At the rear top side of the jet board 200 there are two buttons 320' disposed, ready for engagement with the catcher 313'. One of ordinary skill in the art would see the possibility of a rider installing after-market buttons onto a jet board 200 that does not have any buttons to begin with.

Figure 9:
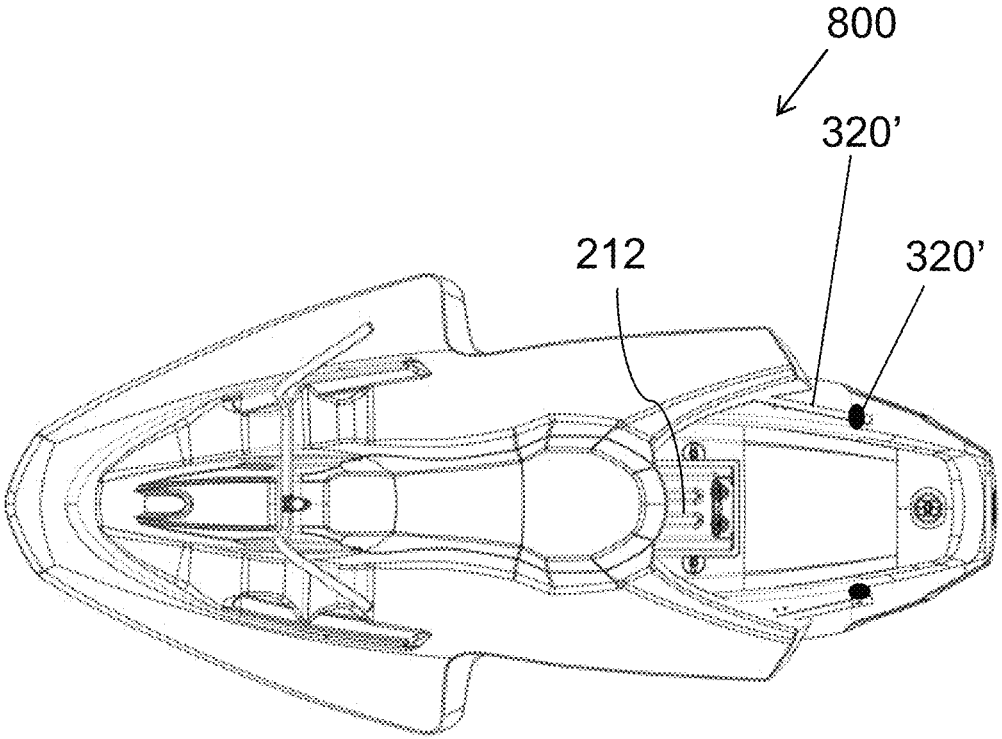
FIG. 9 is a top view of the add-on module of FIG. 8 engaged with a prior art jet board.

Referring now to FIG. 9, the rider has completed inserting a portion of the jet board 200 into the add-on module 100 therefore forming a PWC 800. Here, more than half of the top side of the jet board 200 is covered by the add-on module 100. About half of the battery access cover 212 of the jet board 200 is still exposed from a top view.

As discussed above, whether the coupler 300 is a hook 313 or a catcher 313', the rider attaches the coupler 300 to a corresponding protrusion disposed at a rear portion of the jet board in order to keep the jet board 200 from detaching from the add-on module 100. This protrusion can be a handle 210 or a button 320' as discussed above.

Besides using an elastic band 312, 312', it is also contemplated for the rider to clamp the jet board 200 to the add-on module 100 by using a movable clamping ram (not shown). The rider can use the clamping ram to abut the jet board against a portion of the add-on module 100. When using a clamping ram, the clamping ram applies direct pressure to the lateral side of the jet board. In other words, there can be a clamping ram on the left groove 140 and one on the right groove 140. The two clamping ramps (not shown) move toward each other to grab onto the sides of the jet board 200 when the jet board 200 is received in the docking area 130.

By doing so, the rider uses the clamping rams to apply direct pressure to the two sides of the jet board 200 thereby holding the jet board 200 in place.

In another embodiment, there can be a clamping ram (not shown) that grabs the jet board 200 from the underside of the jet board 200 and pulls it upwards toward the add-on module 100 thereby holding it in place.

In another embodiment, a rider can use a strap (not shown), which may or may not be part of the add-on module 100 and wraps the strap over the underside of the jet board 200 and tie the jet board 200 to the add-on module 100. In this way, the jet board 200 is kept from detaching from the add-on module. In another embodiment, the rider uses the strap the same way, and the add-on module 100 may not even need to have groove 140 as discussed above. In other ways, the add-on module 100 is simply strapped onto the top of a jet board 200 and that would be sufficient to create a PWC 800.

In some particular embodiments, the add-on module 100 is detachably attached only to the front end of the jet board 200.

In some other embodiments, the add-on module 100 is detachably attached only to the top side of the jet board 200.

In still other embodiments contemplated, the add-on module 100 does not have a source of propulsion and PWC 800 is driven forward by the electric propulsion system of the jet board 200.

In still other embodiments contemplated, the hull 110 of the add-on module 100 does not have a rudder or any steering mechanism.

In still other embodiments contemplated, the hull 110 of the add-on module 100 does not have a rudder or any steering mechanism when the add-on module 100 is by itself in water. In such embodiments, the only way to steer the add-on module is to attach it to a jet board 200 and influence direction of the waterflow as the water exits from the jet board's propulsion system.

In still other embodiments contemplated, the only source of propulsion for the PWC 800 to drive forward by using the electric propulsion system of the jet board 200.

In yet another embodiment contemplated, the add-on module 100 can have its own source of propulsion. For example, it can have one or more electric propulsion systems (similar to those found on jet boards 200) attached to or embedded within such that the add-on module 100 can now fit over an ordinary non-motorized board (e.g., surfboard, SUP board, boogie board) to create a PWC 800.

Figure 13:
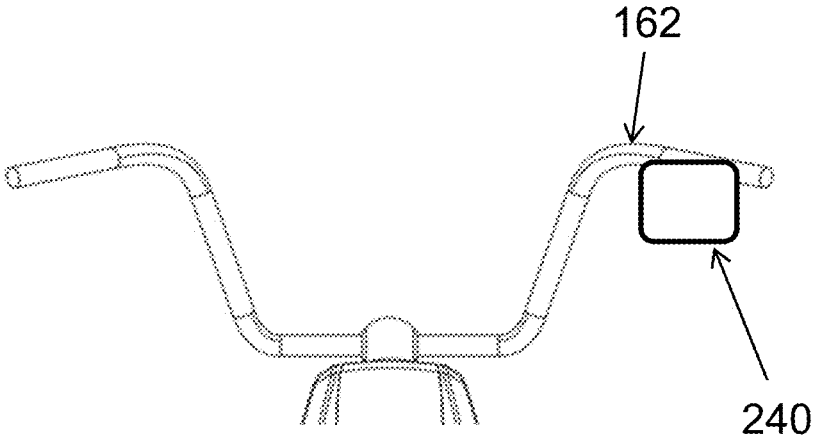
FIG. 13 is an illustration of where a wireless handheld controller can be installed.
Figure 14:
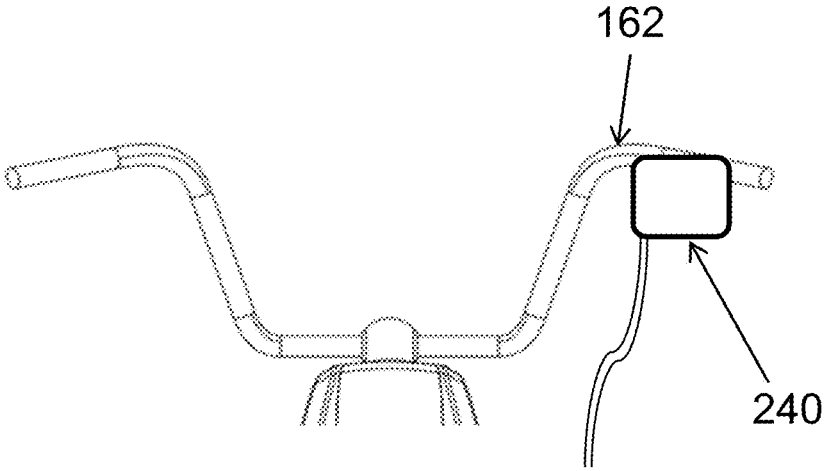
FIG. 14 is another illustration of where a wired handheld controller can be installed.

Jet boards 200 known in the market come with a handheld controller 240 as shown in FIG. 4. This handheld controller 240 is known to be either wired or wireless. In the contemplated method of converting a jet board 200 into a PWC 800, a rider can attach the handheld controller (whether it is wire or wireless) to the handle 210 of the add-on module 100 (see FIGS. 13, 14) so that when a rider is riding the resulting PWC 800, the rider can control an output of the jet board 200 at the handle 210 of the add-on module. In this way, the add-on module 100 itself does not need to come with any electronics or controlling equipment. The add-on module 100 can simply use the handheld controller 240 of the jet board 200 to control the speed of the resulting PWC 800.

Figure 15:
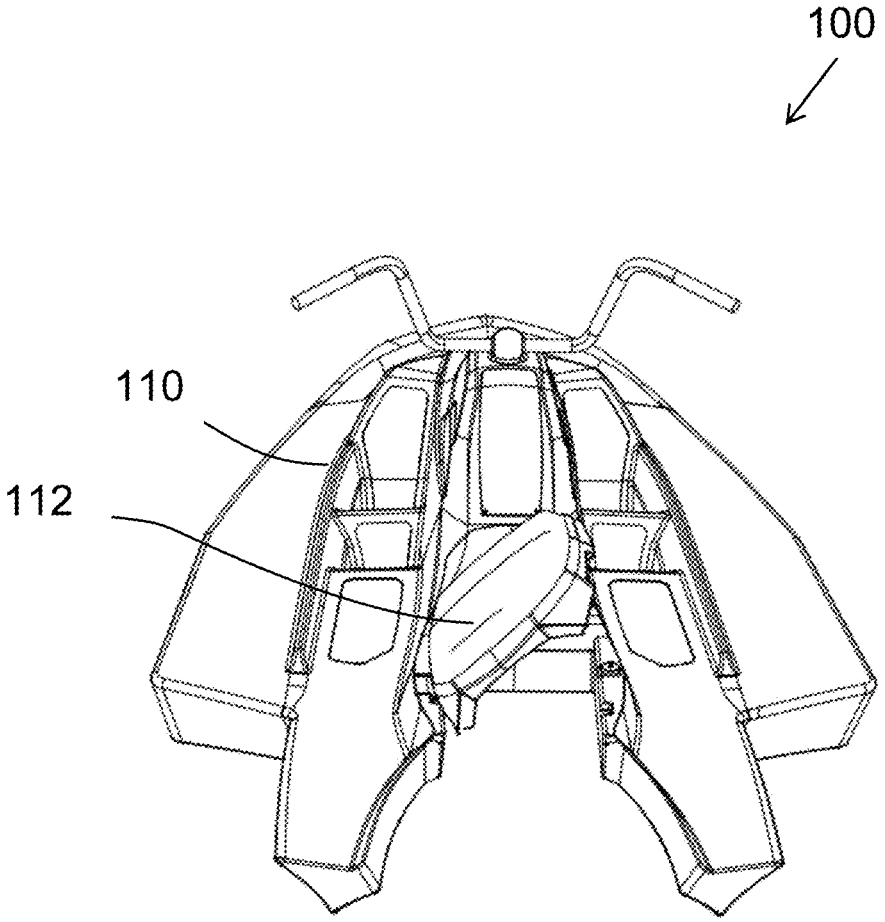
FIG. 15 is a rear perspective view of an add-on module showing a pivotable seat.

Optionally, the rider can access the battery of the jet board 200 when the jet board 200 is attached to the add-on module 100. This can be done by providing a seat 112 that is pivotably attached to the hull 110 (see FIG. 15), thereby allowing user access to the top side of the jet board when the jet board is secured to the add-on module. The seat 112 can pivot on either a left or a right side. Alternatively, the seat can pivot on the front side. When replacing a battery in the resulting PWC 800, the rider would not need to detach the jet board 200 from the add-on module 100. Instead, the rider would pivot open the seat 112 to access the battery access cover 212 under it.

Figure 19:
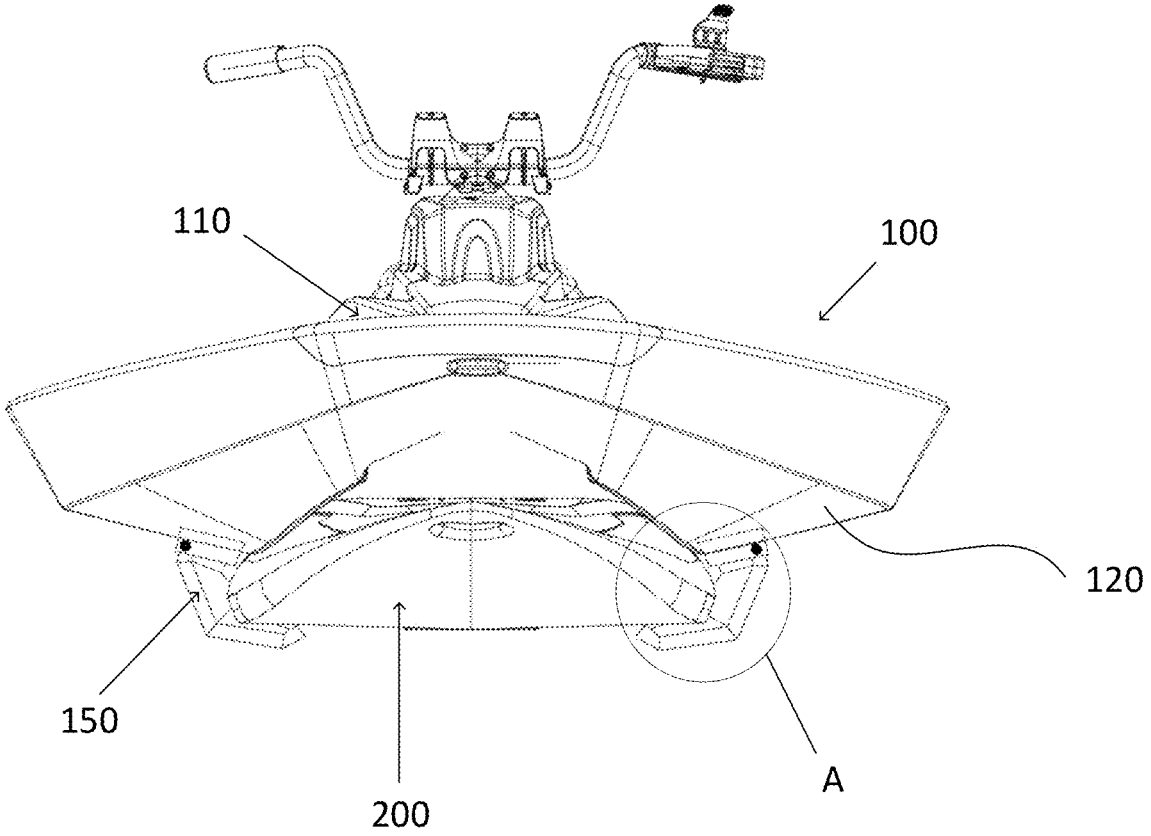
FIG. 19 is a front view of an embodiment of an add-on module using grippers to clamp onto a jet board.

In FIG. 19, the add-on module 100 has a pair of grippers 150 at a bottom of the hull 110, the pair of grippers 150 is stretched at the bottom of the hull 110, and apply direct pressure to the two sides of the jet board 200 thereby holding the jet board 200 in place towards the add-on module 100 thereby forming a PWC.

Figure 20:
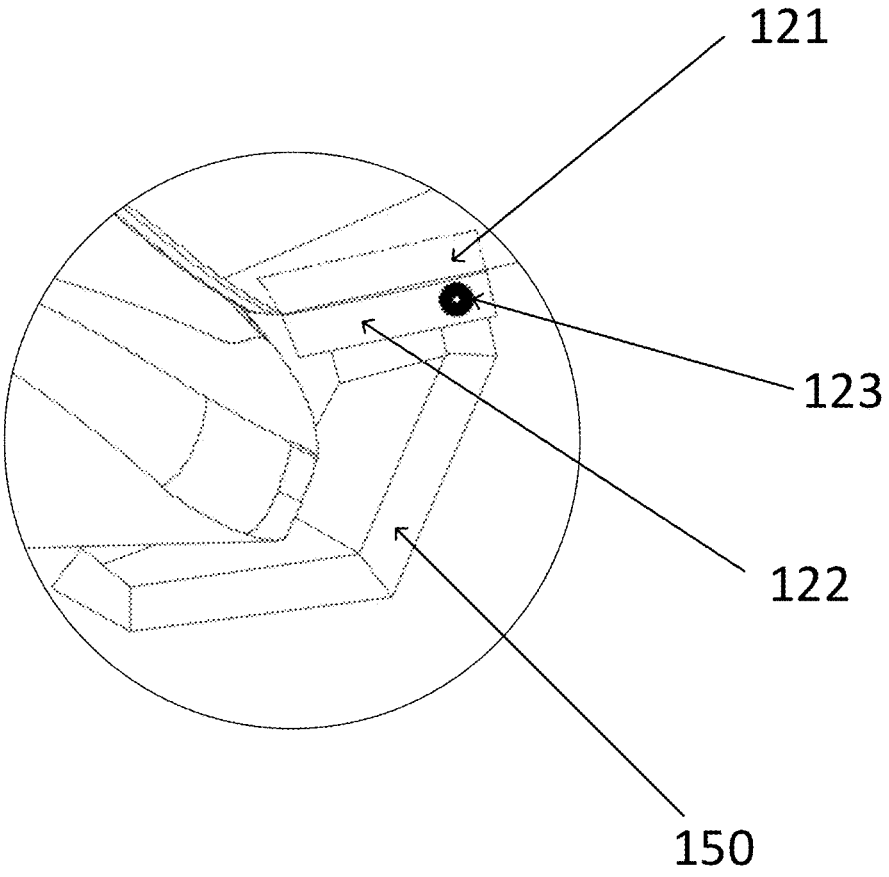
FIG. 20 is a close-up view of the circle A in FIG. 18.
Figure 21:
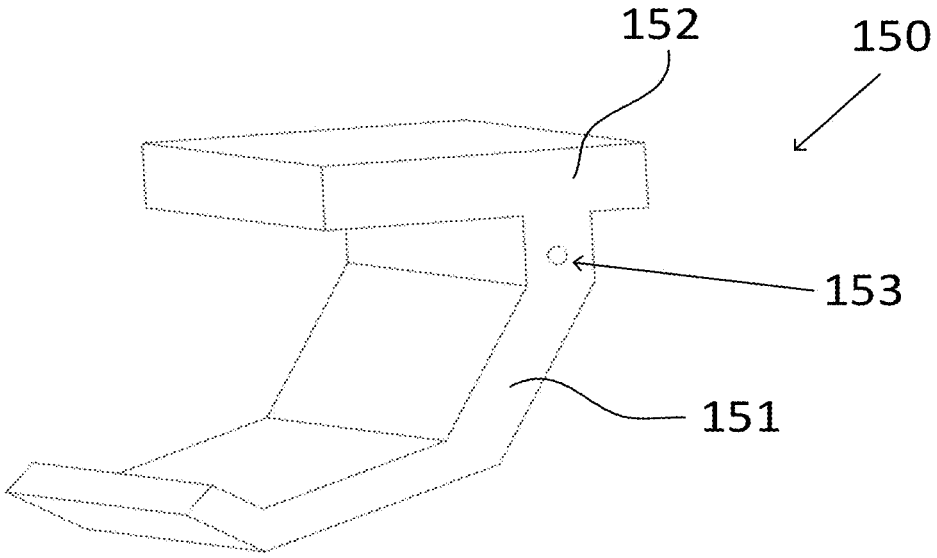
FIG. 21 is a perspective view of a contemplated gripper.
Figure 22:
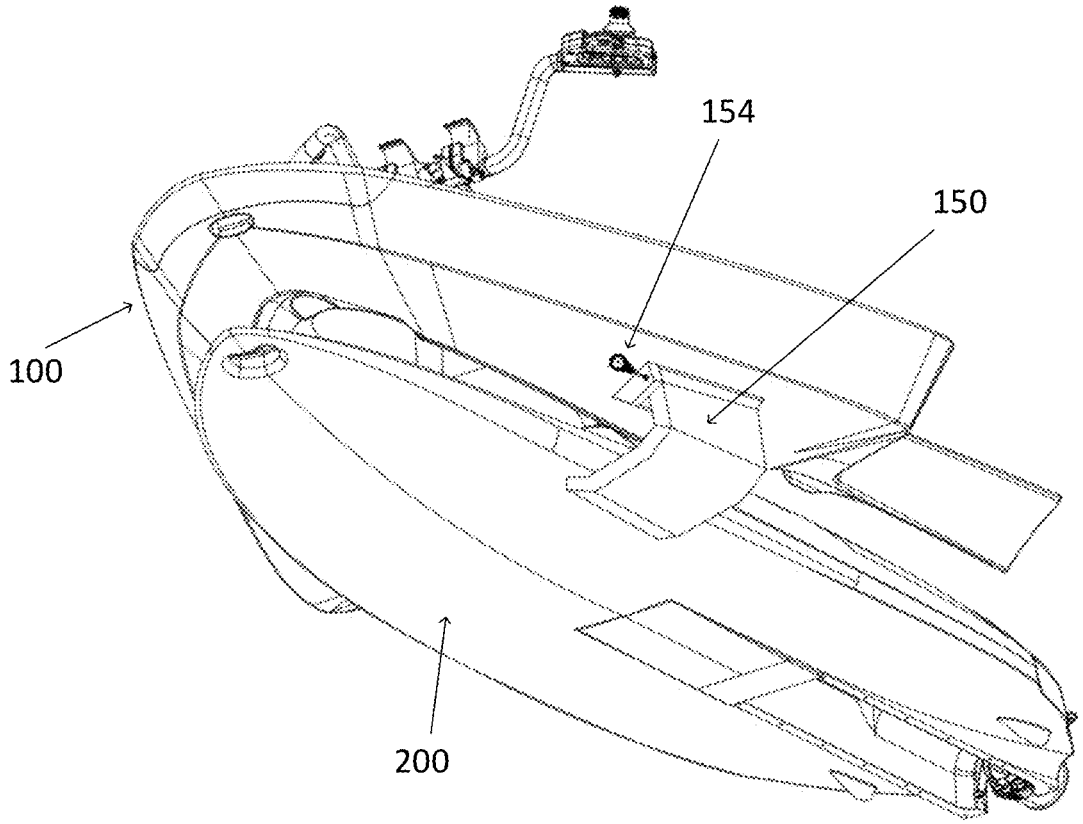
FIG. 22 is a bottom perspective view of the embodiment of FIG. 19.
Figure 23:
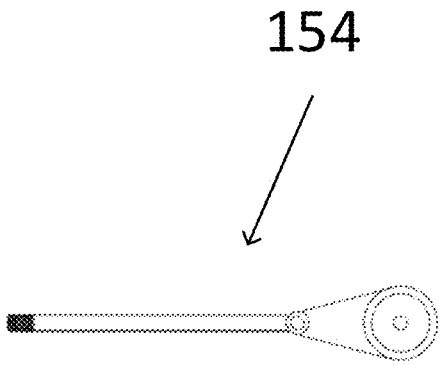
FIG. 23 is a perspective view of a contemplated pin.
Figure 24:
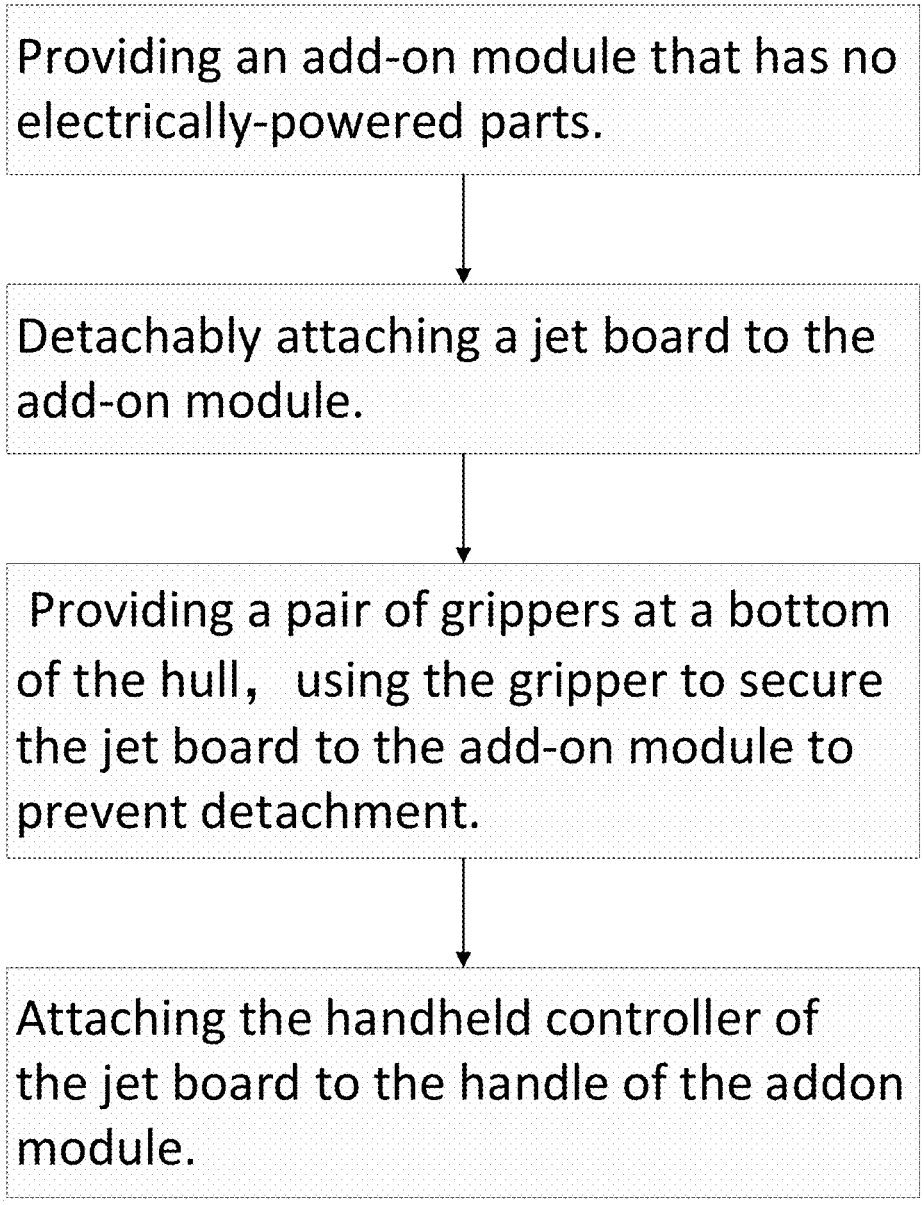
FIG. 24 illustrates another embodiment of method steps to convert a prior art jet board into a personal watercraft.

In one embodiment, at least one movable gripper 150 is detachably attached to a corresponding portion disposed at the bottom of the jet board 200 in order to keep the jet board 200 from detaching from the add-on module 100. As shown in FIG. 20-22, the gripper 150 includes a grip part 151 and a base part 152, wherein the base part 152 is connected to the bottom of the hull 110. Specifically, the bottom of the hull 110 has a pair of slit openings 121 disposed on either side of the hull 110. Each base part 152 is respectively arranged on the inner side of the slit opening 121, that is, the base part 152 remains within the hull 110 while the grip part 151 can be extended through the slit opening 121 and reaching out exterior to the hull 110. The add-on module 100 has, on the exterior of the hull 110 surrounding each slit opening 121, a connecting protrusion 122. The connecting protrusion 122 is a protruding extension of the slit opening 121 providing a first hole 123 to receive a securing pin 154 therein. The grip part 151 also has a corresponding second hole 153 to receive the securing pin 154. A user may insert the securing pin 154 through the first hole 123 and the second hole 153 to secure the gripper 150 into a fixed position relative to the hull 110. Conversely, a user may pull out the securing pin 154 to release the gripper 150 from the jet board 200 by disengaging the fixed position to which the gripper 150 was with the hull 110.

In FIG. 21, while this embodiment shows only one second hole 153, other embodiments may include a series of holes thereby allowing a user to choose the appropriate hole to secure to jet boards 200 of different widths and thicknesses.

In another embodiment, the gripper 150 is pivotably connected (not shown) to the hull 110. Specifically, the grip part 151 of the gripper 150 can be pivotably connected to the base part 152 through a pivoting axis. That is to say, the grip part 151 of the gripper 150 can pivot relatively to the hull 110, in order to press or release the jet board 200 by pivoting the grip part 151 from the two sides of the hull 110. Such pivoting range of movement can be adjusted and fixed securely by using a securing pin and corresponding holes as described above in other embodiments.

In another embodiment, the grip part 151 of the gripper 150 is directly and pivotably connected (not shown) to the hull 110. In general, as long as the gripper 150 can clamp and release the jet board 200, it is not limited to a particular clamping structure. One of ordinary skill in the art would immediately understand that any similar clamping structure and method would also effectively work to secure the add-on module 100 to the jet board 200. In addition, the number of the gripper 150 is not limited to what is shown in the drawings. The position of the gripper 150 is also not limited as shown in the drawings. The contemplated grippers 150 can be installed at other positions of the hull 110 to form a detachable clamping of the jet board 200.

It should be understood that while the majority of this disclosure is about combining a non-motorized add-on module 100 with a motorized jet board 200 to create a PWC, it would be noted that other combinations are also possible. For example, a non-motorized add-on module 100 is contemplated to combine with a non-motorized board (e.g., surfboard, boogie board, SUP board) to create a non-motorized watercraft that may be towed by another watercraft. In another alternative, the add-on module 100 can be motorized (not shown). For example, one or more electric motors may be attached to the add-on module thereby propelling the add-on module 100 forward. While one may think that such motorized add-on module 100 would be sufficient to travel over water on its own without being attached to a surfboard, the preferred embodiments require that the motorized add-on module 100 be attached to one. This would improve the stability of travel and allow the rider to convert his regular surfboard with a rather short and easily transportable motorized add-on module.

In the above disclosed methods and embodiments, a rider may easily store a jet board 200 and an add-on module 100 separately at home thereby making it easy to put them away when not in use. The space it takes to store these two parts together is still much smaller than the space it takes to store a regular PWC. A regular PWC is typically placed on top of a trailer and the entire trailer is parked on a driveway or stored in a garage. This is not to mention the added expense of having to buy a trailer. In comparison, the contemplated add-on module 100 can lay on the floor or be placed in a box or a closet because it is much smaller and lighter.

In terms of transporting them, a rider can easier transport an add-on module 100 inside of a passenger car or a sports utility vehicle without the need to install a hitch to a truck and then attached a trailer to the truck.

While operations and/or method steps may be described above in a particular sequence, this should not be understood as requiring that such operations be performed in the particular order described or in sequential order, or that all illustrated operations and/or method steps be performed, to achieve desirable results. In certain circumstances, multitasking and parallel processing may be advantageous.

Many alterations and modifications may be made by those having ordinary skills in the art without departing from the spirit and scope of the disclosed embodiments. Therefore, it must be understood that the illustrated embodiments have been set forth only for the purposes of example and that it should not be taken as limiting the embodiments as defined by the following claims. For example, notwithstanding the fact that the elements of a claim are set forth below in a certain combination, it must be expressly understood that the embodiment includes other combinations of fewer, more or different elements, which are disclosed herein even when not initially claimed in such combinations.

Thus, specific embodiments and applications of a method to convert a jet board into a personal watercraft have been disclosed. It should be apparent, however, to those skilled in the art that many more modifications besides those already described are possible without departing from the disclosed concepts herein.

What is claimed is:

1. A method of converting a jet board into a personal watercraft, said method comprising:

providing an add-on module having at least one movable gripper;

clamping the gripper toward the jet board to detachably secure the jet board to the add-on module;

wherein the jet board has a lateral side;

wherein the jet board has an underside;

wherein the jet board has a top side;

wherein the jet board has a front end and a rear end;

wherein the jet board has an electric propulsion system;

wherein the add-on module has a hull;

providing at least one handle coupled to the hull;

wherein the add-on module has a front end and a rear end;

wherein the jet board includes an electric surfboard, an electric boogie board, an electric standup paddle (SUP) board, or a hydro-foil board; and wherein the clamping step includes using the at least one movable gripper to apply direct pressure either to the lateral side or to the underside of the jet board; and inserting a securing pin into a hole of the gripper and a hole of the hull to fixedly secure a relative position of the gripper.

2. The method as recited in claim 1, further providing a grip base in the gripper and disposed on an inside of the hull.

3. The method as recited in claim 1, further comprising movably passing a part of the gripper through an opening disposed on the hull.

4. The method as recited in claim 1, wherein the add-on module is detachably attached only to the front end of the jet board.

5. The method as recited in claim 1, wherein the add-on module is detachably attached only to the top side of the jet board.

6. The method as recited in claim 1, wherein the add-on module does not have a source of propulsion and the personal watercraft is driven forward by the electric propulsion system of the jet board.

7. The method as recited in claim 1, wherein the jet board has a handheld controller which allows a user to control an output of the electric propulsion system; further comprising attaching the handheld controller to one of said pair of handles of the add-on module.

8. The method as recited in claim 1, wherein the detachably attaching and securing step includes covering at least a top side of approximately a front half of the jet board with the add-on module.

9. The method as recited in claim 1, wherein the detachably attaching and securing step includes covering the entire top side of the jet board with the add-on module.

10. The method as recited in claim 1, wherein the seat is pivotably attached to the hull, thereby allowing user access to the top side of the jet board when the jet board is secured to the add-on module.

11. The method as recited in claim 1, wherein the add-on module has no electrically-powered parts.

12. The method as recited in claim 1, further comprising attaching the grippers to a corresponding portion disposed at a bottom of the jet board in order to keep the jet board from detaching from the add-on module.

13. The method as recited in claim 1, further providing a grip part and a base part in the at least one movable gripper, wherein the base part is disposed within the hull.

14. The method as recited in claim 13, further providing a pair of openings on either side of the hull, wherein the grip part of the at least one movable gripper is respectively arranged is pass through one of the pair of openings.

15. The method as recited in claim 14, further providing a connecting protrusion approximate to one of said pair of holes, wherein the connecting protrusion has a first hole to receive a securing pin, and the grip part has a second hole to receive the securing pin, thereby fixedly secure the grip part into a particular position relative to the hull.

16. A method of converting a jet board into a personal watercraft, said method comprising:

providing an add-on module having at least one movable gripper;

clamping the gripper toward the jet board to detachably secure the jet board to the add-on module;

wherein the jet board has a lateral side;

wherein the jet board has an underside;

wherein the jet board has a top side;

wherein the jet board has a front end and a rear end;

wherein the jet board has an electric propulsion system;

wherein the add-on module has a hull;

providing at least one handle coupled to the hull;

wherein the add-on module has a front end and a rear end;

wherein the jet board includes an electric surfboard, an electric boogie board, an electric standup paddle (SUP) board, or a hydro-foil board; and wherein the jet board has a handheld controller which allows a user to control an output of the electric propulsion system; further comprising attaching the handheld controller to one of said pair of handles of the add-on module.

17. A method of converting a jet board into a personal watercraft, said method comprising:

providing an add-on module having at least one movable gripper;

clamping the gripper toward the jet board to detachably secure the jet board to the add-on module;

wherein the jet board has a lateral side;

wherein the jet board has an underside;

wherein the jet board has a top side;

wherein the jet board has a front end and a rear end;

wherein the jet board has an electric propulsion system;

wherein the add-on module has a hull;

providing at least one handle coupled to the hull;

wherein the add-on module has a front end and a rear end;

wherein the jet board includes an electric surfboard, an electric boogie board, an electric standup paddle (SUP) board, or a hydro-foil board; and wherein the detachably attaching and securing step includes covering at least a top side of approximately a front half of the jet board with the add-on module.

* * * * *